US007190386B2

(12) United States Patent
Yamamoto et al.

(10) Patent No.: US 7,190,386 B2
(45) Date of Patent: Mar. 13, 2007

(54) THERMAL PRINT HEAD

(75) Inventors: Masaya Yamamoto, Kyoto (JP); Shinobu Obata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 182 days.

(21) Appl. No.: 10/533,491

(22) PCT Filed: Oct. 29, 2003

(86) PCT No.: PCT/JP03/13889

§ 371 (c)(1),
(2), (4) Date: Apr. 28, 2005

(87) PCT Pub. No.: WO2004/039593

PCT Pub. Date: May 13, 2004

(65) Prior Publication Data

US 2006/0098080 A1 May 11, 2006

(30) Foreign Application Priority Data

Oct. 29, 2002 (JP) ..... 2002-314230

(51) Int. Cl.
*B41J 2/34* (2006.01)

(52) U.S. Cl. ..... 347/208

(58) Field of Classification Search ..... 347/200, 347/202, 203, 204, 206, 208
See application file for complete search history.

(56) References Cited

U.S. PATENT DOCUMENTS

| | | | | |
|---|---|---|---|---|
| 6,424,367 | B1 * | 7/2002 | Obata et al. | 347/208 |
| 6,469,724 | B1 * | 10/2002 | Hayashi et al. | 347/204 |
| 6,614,460 | B2 * | 9/2003 | Susukida et al. | 347/202 |
| 2005/0219349 | A1 * | 10/2005 | Takeya et al. | 347/204 |

FOREIGN PATENT DOCUMENTS

| | | |
|---|---|---|
| JP | 63-74657 | 4/1988 |
| JP | 63-249666 | 10/1988 |
| JP | 7-30218 | 1/1995 |
| JP | 11-240190 | 9/1999 |
| JP | 2000-103106 | 4/2000 |
| JP | 2001-96783 | 4/2001 |

* cited by examiner

*Primary Examiner*—K. Feggins
(74) *Attorney, Agent, or Firm*—Hamre, Schumann, Mueller & Larson, P.C.

(57) ABSTRACT

A thermal print head includes an insulating board (2), a glaze layer (21) formed on the board (2), a wiring pattern (22) formed on the glaze layer (21), and an electrode (6) connected to the wiring pattern (22). The electrode (6) includes a pad (61) provided on the wiring pattern (22), and an upper layer (62) formed on the pad (61). The upper layer (62) has a higher solderability than the pad (61) while also having a smaller surface area than the pad (61).

7 Claims, 6 Drawing Sheets

THERMAL PRINT HEAD

TECHNICAL FIELD

The present invention relates to a thermal print head including an electrode having a multi-layer structure.

BACKGROUND ART

An example of conventional thermal print head is shown in FIGS. 7 and 8. As shown in FIG. 7, a conventional thermal print head 101 includes an insulating board 102, a heating resistor 103, and a drive IC 104. The board 102 is provided with a connector 105 for connecting to an external device.

As shown in FIG. 8, the surface of the board 102 is provided with a glaze layer 121. The upper surface of the glaze layer 121 is provided with a predetermined wiring pattern 122. The wiring pattern 122 is partly provided with conductive pads 161 which serve as electrodes. The connector 105 is provided with a plurality of pins 151, and each pin 151 includes an engaging portion 151*a* for clamping the board 102. When the connector 105 is attached to the board 102, each pin 151 contacts a corresponding electrode 161. For preventing dropout of the connector 105 from the board 102, resin 107 is provided to partially cover the pin 151 at the upper and lower surfaces of the board 102.

Due to the above-described structure, the resin 107 can keep the pin 151 and the electrode 161 in contacting manner. However, for example, if heat is applied on the resin 107 when the print head is driven, the resin 107 is softened so that the pin 151 may be detached from the electrode 161.

The above-described problem can be solved by soldering the pin to the electrode. An example of such arrangement is disclosed in JP-A-07-30218. Specifically, as shown in FIG. 4 of the above application, a pin (24) is soldered to an electrode (15) on a glaze layer (12), and then partially covered by a protecting resin (21). With such an arrangement, even if the protecting resin is softened due to heat, the pin and the electrode can keep their jointed manner.

However, soldering causes following disadvantage. Solder tends to contract when solidified. Thus, when the pin is soldered to the electrode, as the solder contracts, the electrode may be detached from the glaze layer or the glaze layer may be damaged.

DISCLOSURE OF THE INVENTION

The present invention has been conceived under above-described circumstances. It is therefore an object of the present invention to provide a thermal print head where detachment of the electrode or damage to the glaze layer is unlikely to occur at the time of soldering.

A thermal print head provided by the present invention comprises an insulating board, a glaze layer formed on the board, a wiring pattern formed on the glaze layer, and an electrode connected to the wiring pattern. The electrode includes a pad provided on the wiring pattern and an upper layer formed on the pad. The upper layer has a higher solderability than the pad while also having a smaller area than the pad.

Preferably, the upper layer has a selected dimension which is no greater than 0.75 times a corresponding dimension of the pad.

Preferably, a joint surface area between the pad and the upper layer is no greater than $0.75^2$ times an upper surface area of the pad.

Preferably, the pad is made of Ag, the upper layer being made of a material selected from the group comprising Ag containing a solderability-improving additive, Ag—Pt and Ag—Pd.

Preferably, the additive is bismuth oxide.

Preferably, the pad includes a corner having a contained angle of larger than 90° as viewed in plan for preventing stress concentration.

Preferably, the thermal print head of the present invention further comprises a pin contacting the electrode for external connection, The pin being is soldered to the upper layer.

BEST MODE FOR CARRYING OUT THE INVENTION

Preferred embodiments of the present invention are specifically described below with reference to the accompanying drawings.

FIGS. 1–4 illustrate a thermal print head according to a first embodiment of the present invention. The illustrated thermal print head 1 includes an insulating board 2, a heating resistor 3, a plurality of drive ICs 4, and a connector 5 (see FIG. 1).

Figure 1:
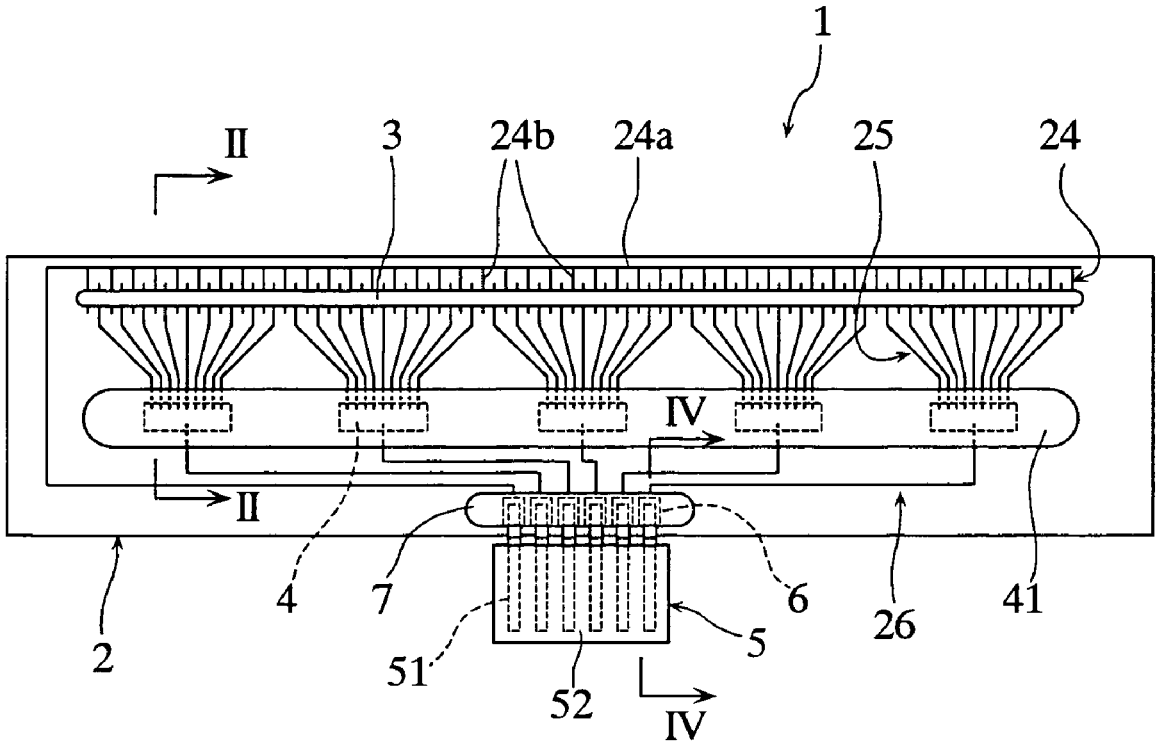
FIG. 1 is a plan view illustrating a thermal print head according to a first embodiment of the present invention.

The board 2 is made of alumina ceramic for example, and is rectangular as shown in FIG. 1. The upper surface of the board 2 is provided with a glaze layer 21 consisting primarily of glass (see FIGS. 2 and 4). The heating resistor 3 and the drive IC 4 are provided on the glaze layer 21 together with a wiring pattern 22 forming a predetermined circuit. The glaze layer 21 serves as a thermal storage layer. The glaze layer 21 covers the entire upper surface of the board 1. The upper surface of the board 2 is further provided with a glass layer 23 for protecting the heating resistor 3 and the wiring pattern 22.

Figure 3:
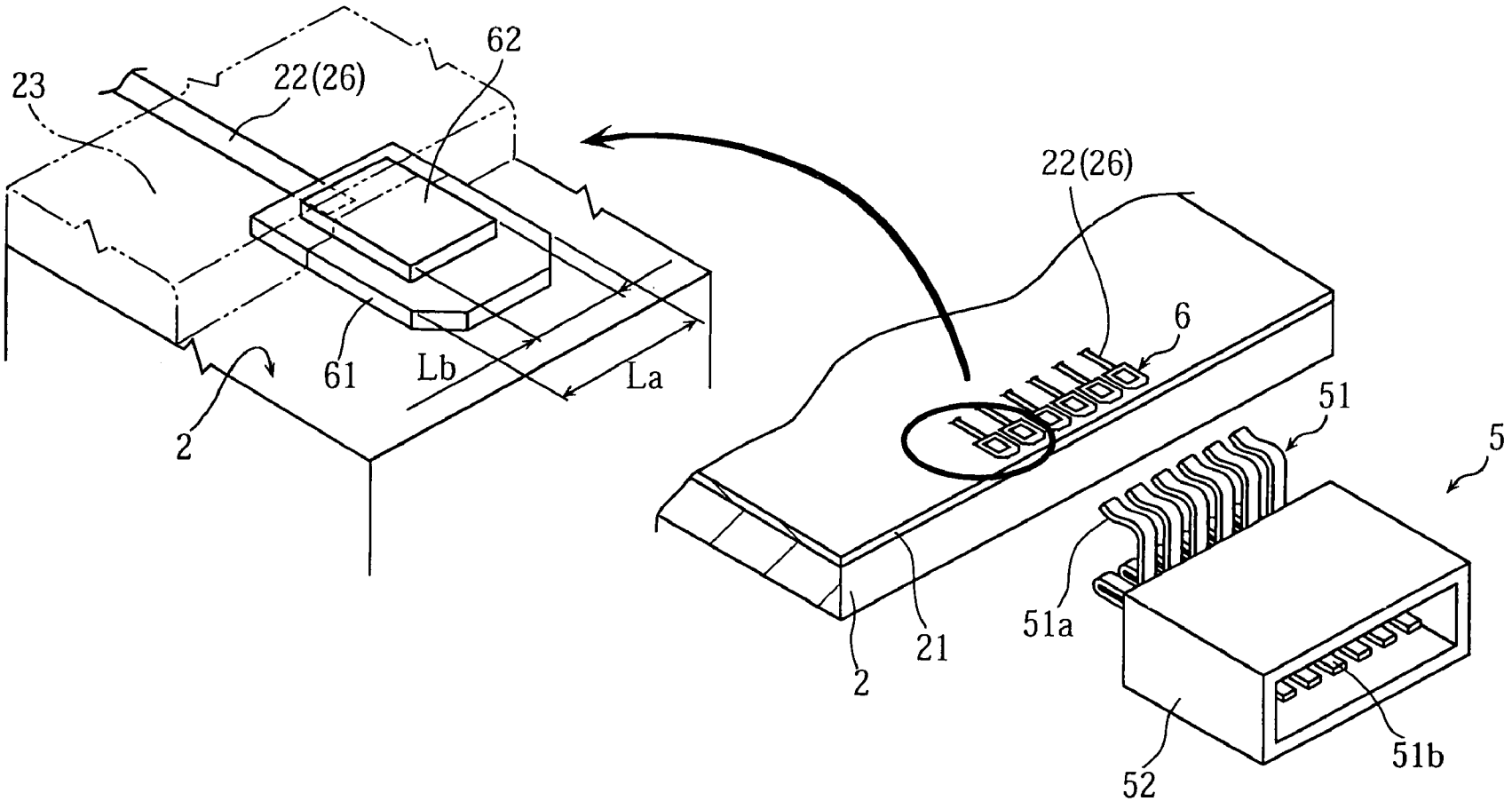
FIG. 3 is a schematic view illustrating a structure of an electrode connected by a pin for external connection.

The wiring pattern 22 is made of a highly conductive metal such as Au. As shown in FIG. 1, the wiring pattern 22 includes a common wiring 24, a plurality of individual leads 25, and a plurality of input leads 26. The common wiring 24 includes a common line 24*a* (extending longitudinally of the board 2) and a plurality of extensions 24*b* (extending perpendicularly from the common line 24*a*). Each individual lead 25 includes a first end and a second end, where the first end is placed between two corresponding extensions 24*b* with the second end connected to an output terminal of corresponding drive IC 4. As shown in FIG. 3, each input lead 25 also includes a first end and a second end, where the first end is connected to an input terminal of corresponding drive IC 4 with the second end connected to the connector 5. As shown in FIG. 3, the second end of each input lead 26 is formed with an electrode 6 to which the connector 5 is soldered. The electrode 6 includes a pad 61 (formed on the input lead 26) and an upper layer 62 (formed on the pad 61) (see FIG. 4).

The pad 61 has a width larger than the input lead 26 for covering the input lead 26 to prevent its detachment. The pad 61 can be formed by printing and baking an Ag paste. As shown in FIG. 3, the pad 61 is polygonal (hexagonal), though the present invention is not limited to this. For example, the pad may be elliptic.

The upper layer 62 is formed of a material having solderability higher than the pad 61. As shown in FIG. 3, the upper layer 62 is formed to be smaller than the pad 61 as viewed in plan. Specifically, the upper layer 62 does not laterally protrude beyond the upper surface of the pad 61, and the joint surface of the upper layer 62 and the pad 61 is smaller than the upper surface of the pad 61. For example, the upper layer 62 may be formed of an alloy such as Ag—Pt or Ag—Pd. Further, the upper layer 62 may be formed of a material including, in addition to Ag, a substance for improving solderability. An example of the added substance includes bismuth oxide, for example.

As shown in FIG. 1, the heating resistor 3 extends across the extensions 24*a* of the common wiring 24 and the individual leads 25. The heating resistor 3 is formed by printing and baking a resistor paste which includes e.g. ruthenium oxide as a conductive component.

Figure 2:
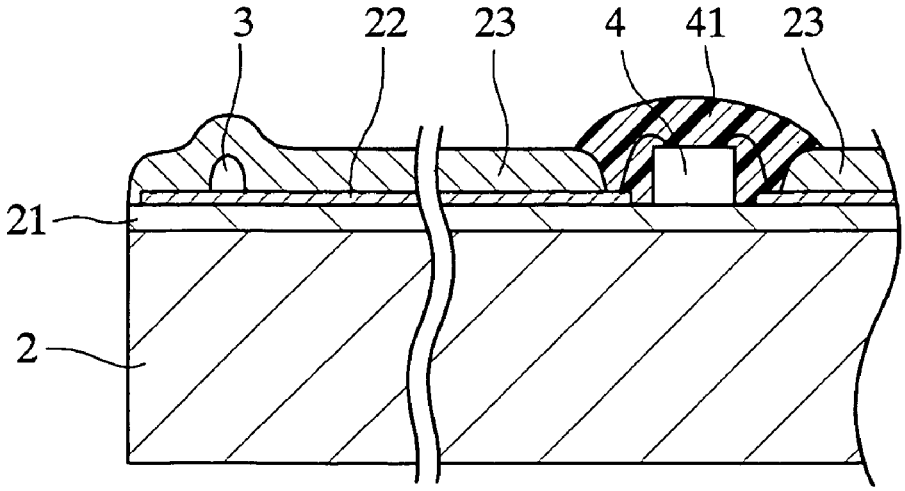
FIG. 2 is a sectional view taken along lines II—II in FIG. 1.

Each drive IC 4 controls the heat generation at the heating resistor 3 based on the printing data sent from an external device. As shown in FIG. 2, the drive IC 4 is attached on the board 2 by die bonding. Further, the input and output terminals of the drive IC 4 are connected to the individual leads 24 and the input lead 25 by wire bonding. The drive IC 4 is covered by a protection resin layer 41.

The connector 5 connects the thermal print head 1 and the non-illustrated external device (via a flexible cable for example). As shown in FIG. 3, the connector 5 includes a plurality of pins 51 and a resin socket 52. Each pin 51 includes an engaging portion 51*a* at one end and an end portion 51*b* extending into the socket 52 at the opposite end. In soldering the connector 5 on the board, the connector 5 is first placed on the board 2 so that each electrode 6 of the board 2 engages a corresponding pin 51. Next, a soldering paste is applied around the contact between the engaging portion 51*a* and the upper layer 62 of the electrode. This step needs care so that the soldering paste is not applied on the pad 61. (If the pad 61 has a sufficiently low solderability, the soldering paste may be applied to the pad 61) Thereafter, the pin 51 is heated by e.g. a hot plate for melting the applied solder which is then cooled and solidified.

Figure 4:
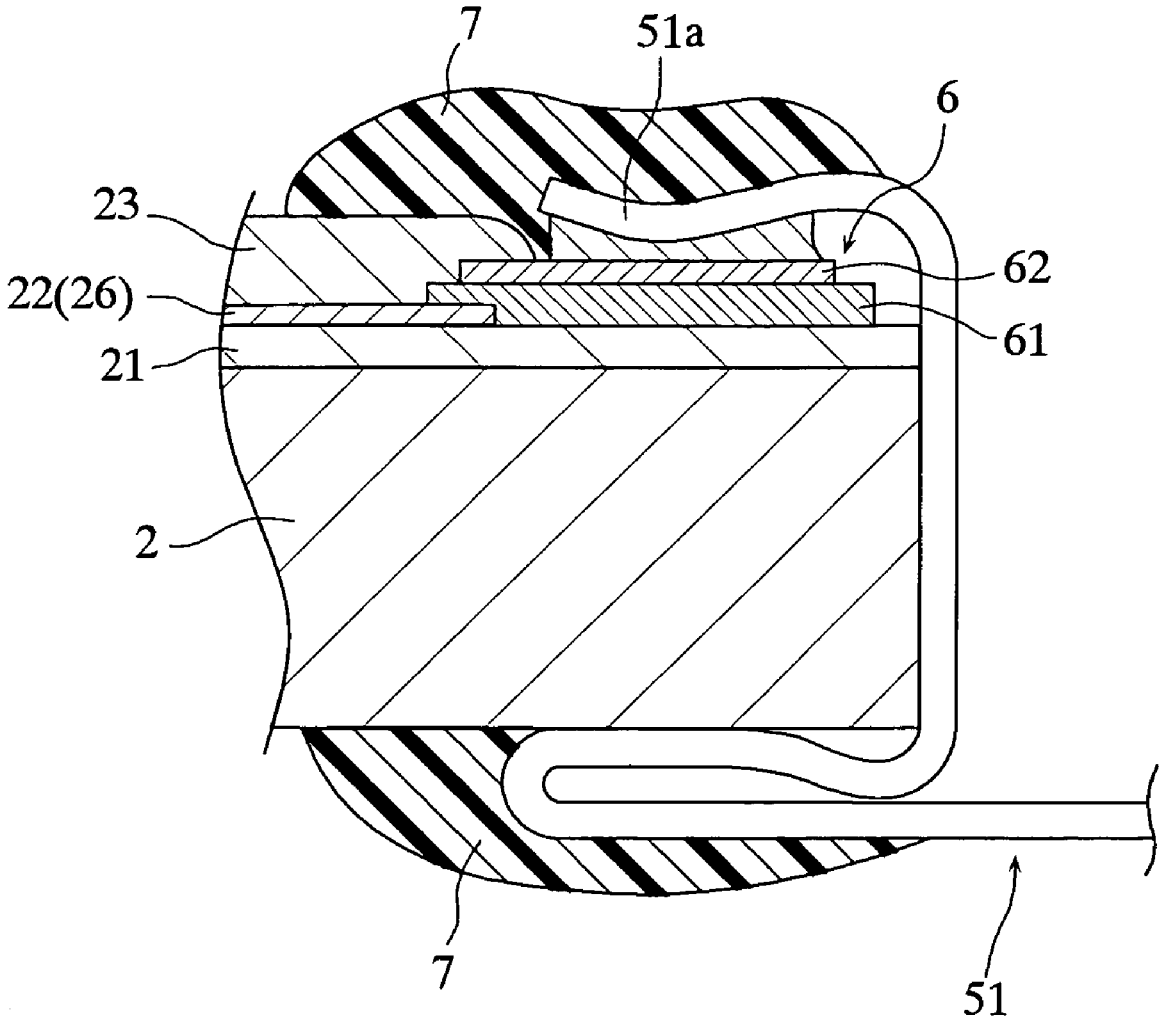
FIG. 4 is a sectional view taken along lines IV—IV in FIG. 1.

As shown in FIG. 4, the connector 5 is partially covered by a resin layer 7 for preventing removal. In the illustrated example, the resin layer covers the engaging portion 51*a* (at the upper surface of the board 2) and a lower portion opposite to the engaging portion (at the lower surface of the board 2). The resin layer 7 is made of a UV-hardening resin, for example.

The above-described thermal print head 1 has the following advantages.

As shown in FIG. 4, the pin 51 is soldered to the upper layer 62 of the electrode 6. As described above, as the upper layer 62 has a high solderability, the pin 51 can be fixed firmly to the upper layer 62.

Further, the upper layer 62 is smaller than the pad 61. Such an arrangement can make the force, which is applied to the electrode 6 and the glaze layer 21 when the applied solder is contracted, weaker than in conventional thermal print head, thereby preventing detachment of the electrode as well as damage to the glaze layer.

As shown in FIG. 3, the pad 61 has a width La and the upper layer 62 has a width Lb. In order to obtain the advantages of the present invention, the pad and the upper layer are formed to satisfy $Lb \leqq 0.75 \times Lb$. Preferably, the length of the upper layer 62 is no greater than 0.75 times the length of the pad 61. In this case, the joint surface area between the upper layer 62 and the pad 61 is no greater than $0.75^2$ times the upper surface area of the pad 61.

The configuration of the upper layer is not limited to be a rectangle but may be a polygon having an n number of corners (n=5, 6, . . . ) or may be a circle or an ellipse. Even in this case, the joint surface area between the upper layer 62 and the pad 61 is preferably no more than $0.75^2$ times the upper surface area of the pad 61.

The pad 61 of the thermal print head 1 includes a portion covered with the protection layer 23 (covered portion) and the other portion (uncovered portion). The covered portion of the pad 61 includes two chamfered corners and thus the contained angle of each corner is larger than 90° as viewed in plan. Such a configuration prevents stress concentration due to the solder contraction and thus contributes to prevent detachment of the electrode 6. On the other hand, the covered portion of the pad 61 includes two corners (having a contained angle of 90°), where stress concentration may generate. However, as these corners are covered by the protection layer 23, detachment of the electrode is prevented.

Figure 5:
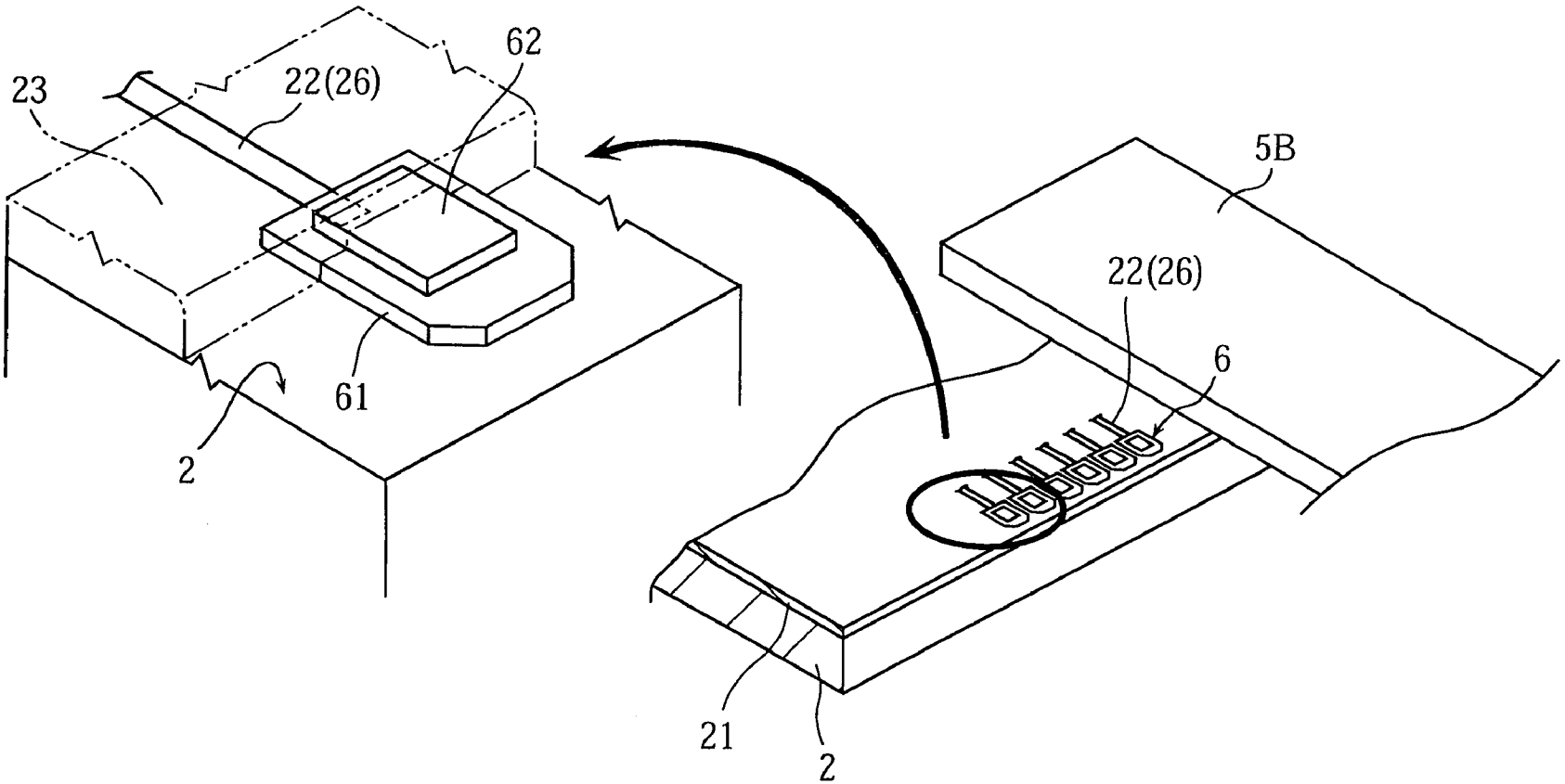
FIG. 5 is a schematic view illustrating a thermal print head according to a second embodiment of the present invention.
Figure 6:
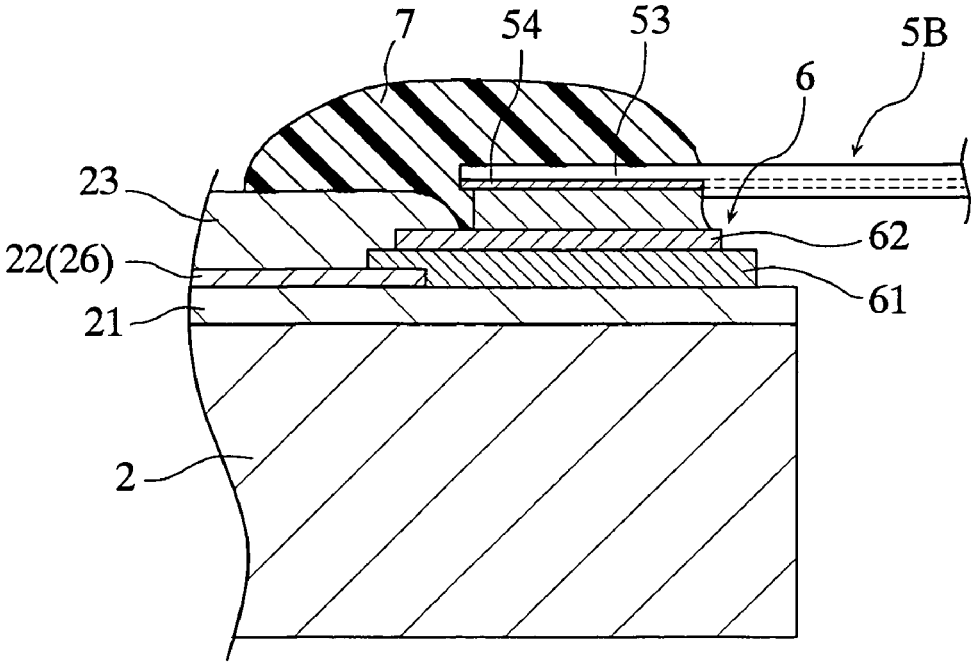
FIG. 6 is a sectional view illustrating a cable for external connection soldered to the electrode of the thermal print head according to the second embodiment.
Figure 7:
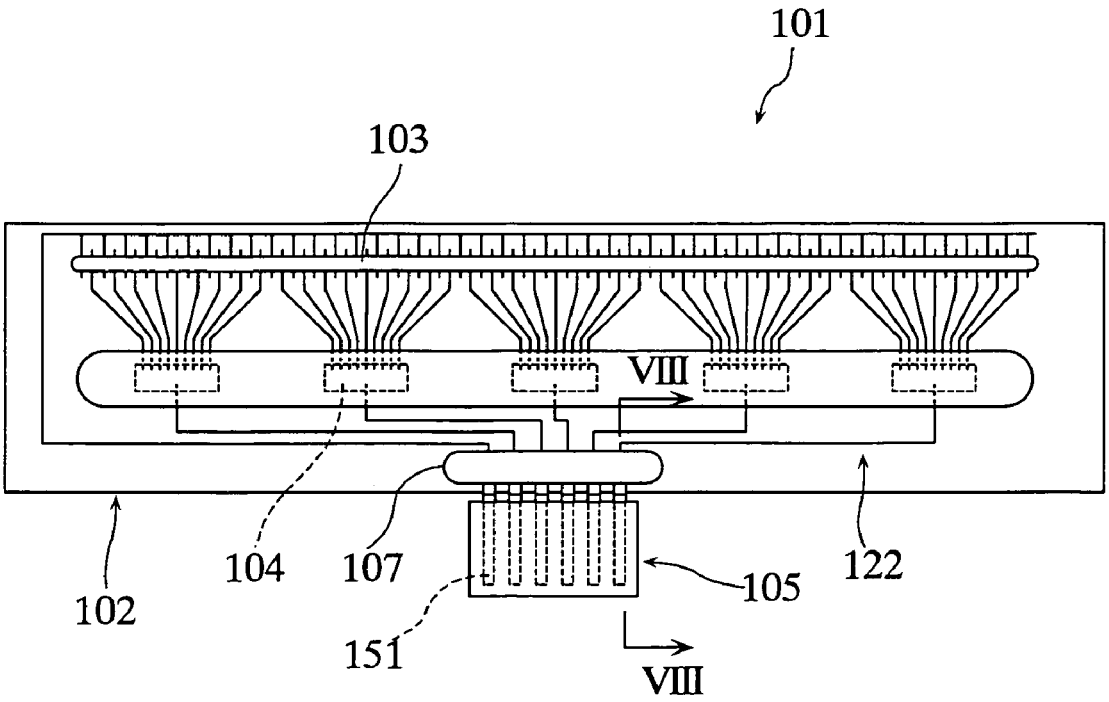
FIG. 7 Prior Art
FIG. 7 is a plan view illustrating a conventional thermal print head.
Figure 8:
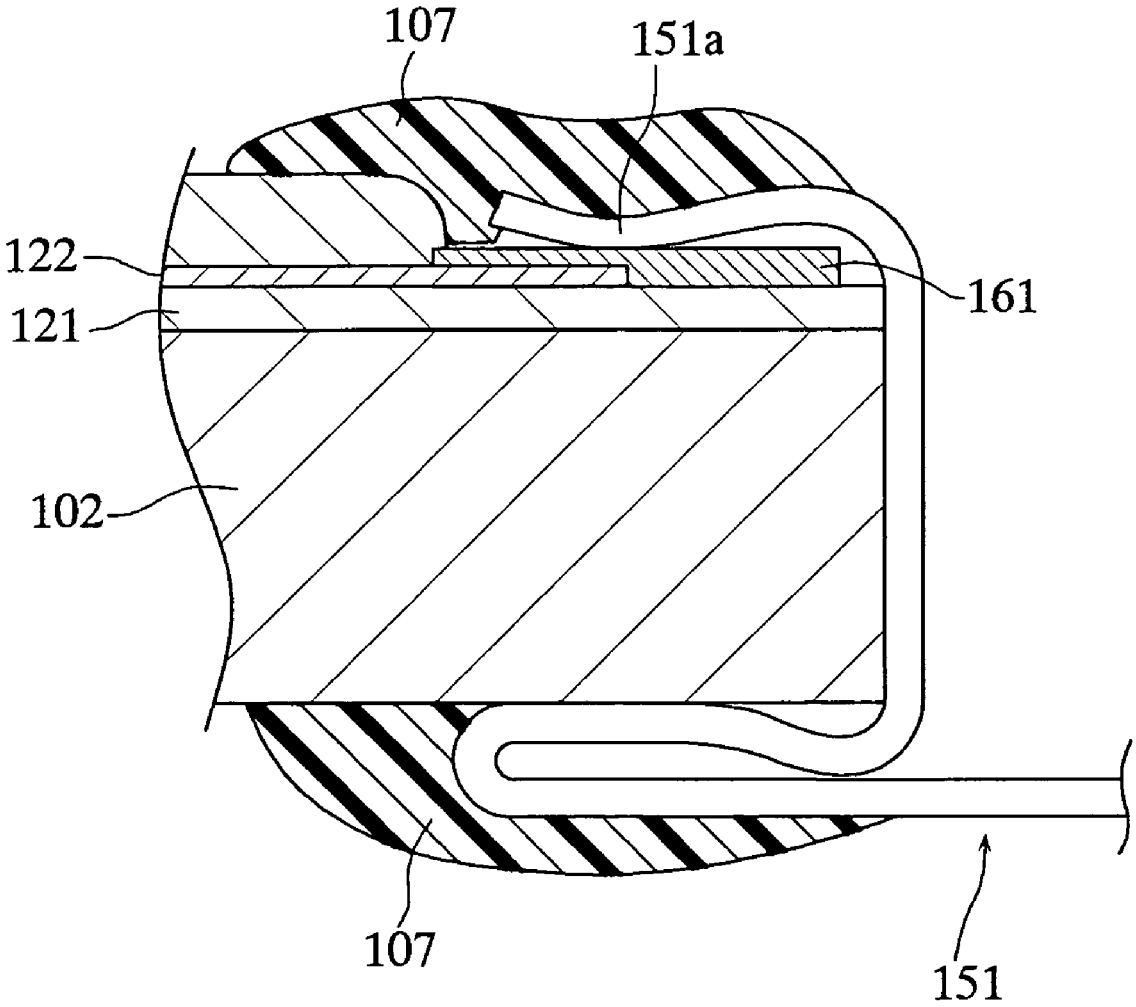
FIG. 8 Prior Art
FIG. 8 is a sectional view taken along lines VIII—VIII in FIG. 7.

FIG. 5 illustrates a thermal print head according to a second embodiment of the present invention. The second embodiment is similar in structure to the first embodiment except for omission of the connector for external connection. Specifically, a flexible cable 5B is connected directly (i.e., without using the connector) to the electrode 6. As can be seen from FIG. 6, the cable 5B includes a pair of resin strips 53 (made of e.g. polyimide) and a plurality of conductive lines 54 provided between these strips. Each of the conductive lines 54 is exposed at one end of the cable to be soldered to a respective electrode 6.

The present invention being thus described, it is obvious that the same may be modified in various ways. Such modifications should not be regarded as a departure from the spirit and scope of the invention, and all such modifications as would be obvious to those skilled in the art are intended to be included in the scope of the appended claims.

The invention claimed is:

1. A thermal print head comprising:

an insulating board;

a glaze layer formed on the board;

a wiring pattern formed on the glaze layer; and an electrode connected to the wiring pattern, wherein the electrode includes a pad provided on the wiring pattern and an upper layer formed on the pad, the upper layer having a higher solderability than the pad while having a smaller area than the pad.

2. The thermal print head according to claim 1, wherein the upper layer has a selected dimension which is no greater than 0.75 times a corresponding dimension of the pad.

3. The thermal print head according to claim 1, wherein a joint surface area between the pad and the upper layer is no greater than $0.75^2$ times an upper surface area of the pad.

4. The thermal print head according to claim 1, wherein the pad is made of Ag, the upper layer being made of a material selected from the group comprising Ag containing a solderability-improving additive, Ag—Pt and Ag—Pd.

5. The thermal print head according to claim 4, wherein the additive is bismuth oxide.

6. The thermal print head according to claim 1, wherein the pad includes a corner having a contained angle of larger than 90° as viewed in plan for preventing stress concentration.

7. The thermal print head according to claim 1, further comprising a pin contacting the electrode for external connection, the pin being soldered to the upper layer.

* * * * *